United States Patent [19]

Fischer

[11] Patent Number: 4,504,731

[45] Date of Patent: Mar. 12, 1985

[54] ELECTRIC HOTPLATE

[76] Inventor: Karl Fischer, Karl-Fischer-Strasse 23, D-7519 Oberderdingen, Fed. Rep. of Germany

[21] Appl. No.: 506,539

[22] Filed: Jun. 21, 1983

[30] Foreign Application Priority Data

Jun. 23, 1982 [DE] Fed. Rep. of Germany ..... 3223417

[51] Int. Cl.[3] ..... H05B 3/68

[52] U.S. Cl. ..... 219/457; 219/459; 219/462; 219/464; 219/468; 219/530; 219/544; 338/253; 338/305

[58] Field of Search ..... 219/377, 430, 439, 459, 219/458, 457, 460, 461, 462, 463, 464, 465, 466, 467, 468, 544, 530, 540, 552; 338/230, 253, 269, 275, 278, 279, 280, 283, 285, 293, 298, 299, 303, 305

[56] References Cited

U.S. PATENT DOCUMENTS

| | | | |
|---|---|---|---|
| 560,588 | 5/1896 | Leonard | 338/280 X |
| 1,547,837 | 7/1925 | Steenstrup | 338/230 |
| 1,645,867 | 10/1927 | Louthan | 338/285 X |
| 1,709,438 | 4/1929 | Moffat | 219/464 |
| 1,868,620 | 7/1932 | Wiegand | 338/293 X |
| 2,164,650 | 7/1939 | Goldthwaite | 219/464 X |
| 2,195,705 | 4/1940 | Morgan | 338/253 X |
| 2,260,165 | 10/1941 | Calhoun | 219/467 X |
| 2,290,901 | 7/1942 | Weinhardt et al. | 219/467 X |
| 2,359,983 | 10/1944 | Fry | 219/462 X |
| 2,409,244 | 10/1946 | Bilan | 219/457 |
| 2,664,492 | 12/1953 | Fischer | 219/457 X |
| 2,691,717 | 10/1954 | Huck | 219/462 |
| 2,851,572 | 9/1958 | Steck | 219/457 |
| 3,221,203 | 11/1965 | Ragland, Jr. | 219/544 X |
| 3,300,621 | 1/1967 | Fischer | 219/457 |
| 3,346,720 | 10/1967 | Siegla | 219/464 |
| 3,621,200 | 11/1971 | Watts, Jr. | 219/377 |
| 4,002,883 | 1/1977 | Hurko | 219/464 X |

FOREIGN PATENT DOCUMENTS

| | | | |
|---|---|---|---|
| 153865 | 7/1938 | Austria | 219/459 |
| 896966 | 11/1953 | Fed. Rep. of Germany | 219/464 |
| 962920 | 5/1957 | Fed. Rep. of Germany | 219/457 |
| 1075817 | 2/1960 | Fed. Rep. of Germany | 219/464 |
| 2045674 | 3/1972 | Fed. Rep. of Germany | 219/457 |
| 3033828 | 4/1982 | Fed. Rep. of Germany . | |
| 3049521 | 7/1982 | Fed. Rep. of Germany . | |
| 880865 | 4/1943 | France | 219/457 |
| 31112 | 9/1964 | German Democratic Rep. | 219/459 |
| 67620 | 3/1944 | Norway | 219/464 |
| 175609 | 8/1935 | Switzerland | 219/464 |
| 321446 | 6/1957 | Switzerland | 219/457 |
| 2077560 | 12/1981 | United Kingdom | 219/457 |

*Primary Examiner*—Volodymyr Y. Mayewsky
*Attorney, Agent, or Firm*—Steele, Gould & Fried

[57] ABSTRACT

An electric hotplate has a hotplate body with a closed cooking surface made from an iron-based sintered material with additions of other metals.

The sintered material hotplate body has a plurality of narrow, flat slots on its bottom, in which is inserted an uncoiled, slightly undulating heating resistor wire. According to a variant, said heating resistor comprises a strip.

16 Claims, 3 Drawing Figures

FIG. 1
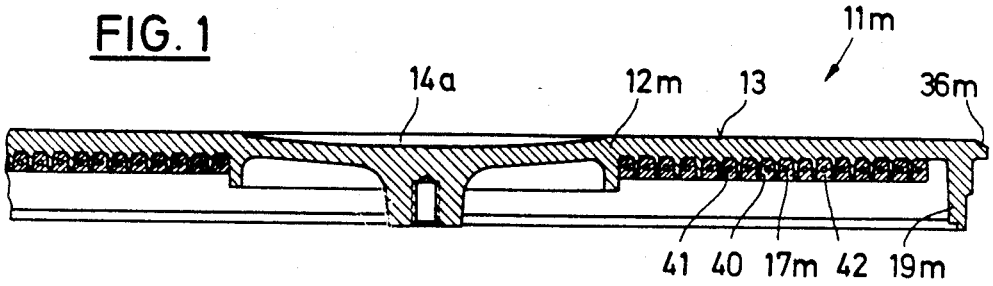
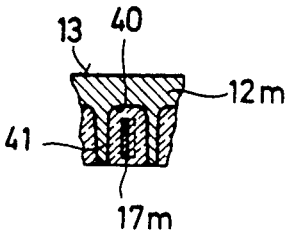
FIG. 2
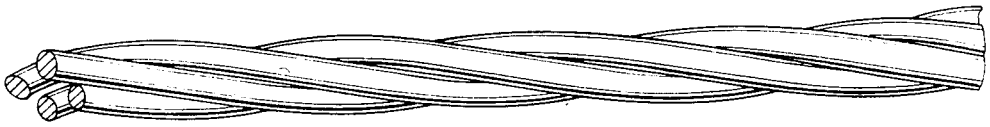
FIG. 3

ELECTRIC HOTPLATE

BACKGROUND OF THE INVENTION

The invention relates to an electric hotplate with a hotplate body, which has a substantially closed cooking surface, which is heated by at least one electrical heating element, and which is made from a metallic sintered material.

German Patent Applications No. P30 33 828.4 and No. P30 49 521 already propose the use of a plate-like hotplate body having tubular heating elements with a triangular cross-section pressed onto its bottom surface, in plate of heater coils inserted in slots. The hotplate body is very easy to manufacture, but it is subsequently necessary to fit the tubular heating element and provide it with an insulation, which presses it against the bottom of the hotplate body.

SUMMARY OF THE INVENTION

The object of the present invention is to further develop this idea, in order to facilitate manufacture. According to the invention, this problem is solved by use of a hotplate made from sintered material and by use of an uncoiled, slightly undulating electrical heating resistor disposed in such slots and embedded in a thermally conductive, electrically non-conductive material.

The possibility of manufacturing the hotplate with a relatively limited material thickness contributes to reducing the warming-up time to lower energy consumption.

A hotplate made from sintered material also offers manufacturing advantages, because the sintered material can be manufactured with the final surface, thereby obviating freecutting machining.

The sintered material is preferably in the form of horizontal layers having different material compositions. For strength and/or thermal reasons, it is possible to use a different material composition at the top or bottom, or alternatively at the outside or inside. The sintered material can be based on iron dust with other metal additives, so that the desired properties, such as resistance to corrosion for example, can be obtained. It is also possible to obtain a surface protection as a result of the arrangement in different layers and with a limited consumption of high-grade alloying constituents.

Due to the precision of sintering, the spiral slots and grooves can be made so narrow and the plate so thin, that its weight and thermal capacity is considerably reduced. The heating elements can comprise uncoiled and only slightly undulatory wires or strips, as well as stranded wires, which can absorb limited elongation differences.

BRIEF DESCRIPTION OF THE DRAWINGS

Further advantages and features of the invention can be gathered from the description of the preferred embodiments and the drawings.

FIG. 1 is a vertical section through an electric hotplate.

FIG. 2 is a detail of a variant.

FIG. 3 is an enlarged side elevation of a stranded wire heating resistor.

DETAILED DESCRIPTION OF THE PREFERRED EMBODIMENTS

A particularly tight and mechanically strong sintered material is obtained by molding under vacuum.

FIG. 1 is a section through an electric hotplate 11*m*, whose hotplate body 12*m* is made from sintered material. Hotplate body 12*m* is made from sintered material, which is based on iron dust and which can contain different pulverulent additives of different metals, such as copper, chrome, nickel, aluminium, manganese, etc. The upper flat cooking surface 13 is depressed somewhat in the central area 14*a* and terminates at the outer periphery in an outwardly directed flange 36*m*, in whose vicinity is connected an outwardly projecting ring edge 19*m*, onto whose outer surface a flush ring (not shown) can be tightly pressed.

Below the annular, closed cooking surface 13 the hotplate heating system is in the form of heating resistors 17*m*, received in spirally arranged slots 40. The slots 40 are located on the bottom of the hotplate body and are separated from one another by ribs 41 of said body 12*m*. Unlike in the case of conventional hotplates, the depth and width of the slots is very small and is less than 5 mm and is preferably 3.5 mm. The thickness of the ribs need only be 0.8 to 1 mm, so that there is an inside slot diameter of approximately 2.5 mm. Heating resistors are placed in the slots. The heating resistors 17*m* are in the form of slightly undulating solid wires, which consequently do not have to be used in the conventional helical form. The slight undulation of the wires makes it possible for the wire to adapt to the hotplate body in the case of any elongation or extension differences. For example, the resistor can be formed from wire which is initially helically wound and is then not completely pulled taut.

However, it is also possible to produce the heating resistors from stranded wires, which comprise e.g. 3 to 5 strands, which are twisted or stranded relative to one another with a relatively limited twist, as shown in FIG. 3.

As shown in FIG. 2, it is also possible to produce the heating resistors from a strip 17*m*, which is also slightly undulated and is arranged at right angles to the bottom of the hotplate body in slot 40.

Heating resistors 17*m,n* are embedded in the slots in an embedding material 42, which comprises electrically insulating pulverulent loose material which, during manufacture, is consolidated by compaction. Due to the limited width or spacing of the slots, it is possible to wind the heating resistor or resistors round in a very large number of spiral turns. Thus, for example, if three electrically differently switchable heating resistors are used, as are required, e.g. for a hotplate with 7 heating settings, said three heating resistors in parallel spiral slots can be placed round a total of 5 times, which leads to a total of 15 parallel slots arranged in accordance with a triple spiral.

During manufacture, which can take place in conventional manner, i.e. working preferably takes place with inert gas in the process stage of molding and sintering in the oven at temperatures well below the melting point (in the case of iron approx. 1100° to 1200° C.). It is advantageously possible to modify the material composition in layers, for example, to use in the vicinity of the outer surfaces particularly dense materials, which consequently have limited sensitivity to fracture, so that a sandwich body is obtained. On the outsides, particularly the top, it is also possible to use materials which are protected against corrosion after sintering.

The present hotplate offers considerable advantages, particularly an improvement in efficiency compared with conventional hotplates and ease of manufacture, which essentially involves no machining.

The very narrow construction of the slots and ribs is made possible by manufacturing by sintering. This process more particularly ensures that the slots are free from any undesired projections and that they have a precisely predetermined surface structure, so that it is also possible to accurately space the heating resistors from the walls of the slots. However, manufacture by sintering also leads to other advantages. Thus, the rib height can be reduced to roughly half, i.e. preferably also 3.5 mm, and the plate thickness, i.e. the distance between cooking surface 13 and the bottom of the slot, can be reduced to approximately 2.5 mm. This also leads to a reduction in the height of the ring edge 19*m*and therefore the complete hotplate to less than 15 mm. Thus, a hotplate can be obtained, which only weighs roughly half compared with a conventional hotplate.

The slight undulation of the heating resistors makes it possible with all types of hotplates made from the most varied materials and different manufacturing modes, to insert a substantially non-undulating wire or a strip into very narrow slots, without there being any danger of fracturing or tearing, or coming into contact with the hotplate body in the case of thermal expansion differences.

What is claimed is:

1. An electric hotplate with a hotplate body having a substantially closed cooking surface, heated by at least one electrical heating element, the hotplate comprising:

the hotplate body formed from a metallic sintered material and having on its bottom surface a plurality of substantially spirally arranged ribs defining slots therebetween;

a thermally conductive and electrically non-conductive embedding material substantially filling the slots; and, an electrical heating resistor disposed along the slots in the embedding material, the resistor having at least one slightly undulating double-curved wire of a form comparable to a substantially stretched-out helix, the curved portions of the resistor effectively preventing distortion of the resistor due to thermal stresses during operation, whereby reduced weight and reduced thermal capacities substantially increase operational efficiency without substantial risk of electrical short circuits between the hotplate body and the heating resistor.

2. An electric hotplate according to claim 1, wherein the distance between adjacent slots and adjacent ribs and the depth of the slots and the height of the ribs is less than 5 mm.

3. An electric hotplate according to claim 2, wherein the at least one heating resistor is a solid wire.

4. An electric hotplate according to claim 3, wherein the thickness of the hotplate body between the cooking surface and the bottom of the slots is less than 3 mm.

5. An electric hotplate according to claim 2, wherein the heating resistor comprises three to five of the slightly undulating double-curved wires intertwined to form a composite stranded wire.

6. An electric hotplate according to claim 5, wherein the thickness of the hotplate body between the cooking surface and the bottom of the slots is less than 3 mm.

7. An electric hotplate according to claim 2, wherein the thickness of the hotplate body between the cooking surface and the bottom of the slots is less than 3 mm.

8. An electric hotplate according to claim 2, wherein the distance is less than 3.5 mm.

9. An electric hotplate according to claim 8, wherein the thickness of the hotplate body between the cooking surface and the bottom of the slots is less than 3 mm.

10. An electric hotplate according to claim 1, wherein the at least one heating resistor is a solid wire.

11. An electric hotplate according to claim 10, wherein the thickness of the hotplate body between the cooking surface and the bottom of the slots is less than 3 mm.

12. An electric hotplate according to claim 1, wherein the heating resistor comprises a plurality of the slightly undulating double-curved wires intertwined to form a composite stranded wire.

13. An electric hotplate according to claim 12, wherein the thickness of the hotplate body between the cooking surface and the bottom of the slots is less than 3 mm.

14. An electric hotplate according to claim 12, wherein the stranded wire comprises three to five of the slightly undulating double-curved wires.

15. An electric hotplate according to claim 14, wherein the thickness of the hotplate body between the cooking surface and the bottom of the slots is less than 3 mm.

16. An electric hotplate according to claim 1, wherein the thickness of the hotplate body between the cooking surface and the bottom of the slots is less than 3 mm.

* * * * *